United States Patent [19]

Martin

[11] 4,341,917

[45] Jul. 27, 1982

[54] BUILDING STRUCTURAL ELEMENT

[76] Inventor: Anthony G. Martin, 12 Scattergood Pl., Spence, Australian Capital Territory, Australia

[21] Appl. No.: 263,806

[22] Filed: May 7, 1981

Related U.S. Application Data

[63] Continuation of Ser. No. 37,064, May 8, 1979, abandoned.

[30] Foreign Application Priority Data

May 10, 1978 [AU] Australia ..... PD4339

[51] Int. Cl.[3] ..... H01L 35/00; E04C 1/10

[52] U.S. Cl. ..... 136/206; 52/588; 126/436; 126/437

[58] Field of Search ..... 52/478, 588, 595; 136/206; 126/431, 436, 437, 450

[56] References Cited

U.S. PATENT DOCUMENTS

| | | | |
|---|---|---|---|
| 2,984,696 | 5/1961 | Shaffer | 136/206 |
| 4,078,546 | 3/1978 | Zani | 126/450 |
| 4,106,952 | 8/1978 | Kravitz | 136/206 |
| 4,141,341 | 2/1979 | Eby | 126/270 |
| 4,184,301 | 1/1980 | Anderson | 52/595 |
| 4,190,039 | 2/1980 | Zani | 126/450 |

*Primary Examiner*—Leland A. Sebastian
*Attorney, Agent, or Firm*—Sughrue, Mion, Zinn, Macpeak & Seas

[57] ABSTRACT

A structural element for a building or like structure comprising a panel member; said panel member including first and second, parallel, external faces and having at least one pair of parallel opposing sides, said panel member having an edge portion extending along each of said opposing sides, each of said edge portions being adapted in use to interconnect with an adjacent structural element; a first one of said edge portions comprising first and second flange members extending longitudinally along one side of said panel member, said first and second flange members being spaced to define between them a first recess which extends longitudinally along said one side of the panel member; and the second one of said edge portions comprising third and fourth flange members extending longitudinally along the opposing side of said panel member, said third and fourth flange members being spaced to define between them a second recess which extends longitudinally along said opposing side of the panel member; said first flange member being disposed outwardly of the plane of one of said external faces of the panel member to increase the structural strength of the element, said second flange member being adapted in use to be received within the second recess of a first identical structural element adjacent to said first edge portion of the panel member and said third flange member being adapted in use to be received within the first recess of a second identical structural element adjacent to said second edge portion of the panel member so that in use said first and second external faces of said panel member are coplanar with the first and second external faces respectively of the panel members of said adjacent identical structural elements.

14 Claims, 22 Drawing Figures

40'
10

40'
10
11'
12'

40'
10

RIDGELINE
111
RIDGELINE
14'
13'
40'

40
10

40
10
12
11

40
10

40
RIDGELINE
14
13

BUILDING STRUCTURAL ELEMENT

This is a continuation of application Ser. No. 37,064, filed May 8, 1979, now abandoned.

This invention relates to a structural element for a building or like structure, and to building or similar structures incorporating one or more such structural elements. In particular, the invention relates to a structural element which may be used in the construction of floor, wall (internal and/or external), ceiling and/or roof structures for buildings and which possess the necessary structural strength in such structures as to avoid the necessity for further supporting structures.

The present invention also relates to structural elements as described above which, in addition to the structural features already mentioned, are designed to carry out the functions of solar energy collection, storage, and the like.

In view of the increasing costs of building by methods which are labour intensive, a great deal of attention has been given in recent years to the development of building systems by which the necessary components of a building can be manufactured as units in a factory or similar production facility, and then transported to the desired site for assembly. Such systems offer the advantages of enabling production in the factory under strictly controlled conditions by mechanised or other methods which are well adapted to the production of large numbers of components, and at the same time enabling the unit cost of the component to be minimised. In addition, since the components may be manufactured in a form ready to be assembled, the assembly thereof on site is reduced to a task requiring only a small number of relatively unskilled workers so that the costs of assembly are also reduced.

It is an object of the present invention to provide a structural element for a building or like system which is particularly suited for manufacture in large numbers in a factory or similar production facility, and which can be used as the basic unit in the assembly on sit of a building using only relatively unskilled labour, which building is structurally complete both internally and externally.

It is a further object of this invention to provide a structural element which may be used to provide the additional function of solar energy collection, storage and the like.

It is yet a further object of this invention to provide a structural element which may be used in the construction of residential housing of one or more levels, as well as in the construction of commercial buildings and buildings for other purposes, such as agricultural purposes, and wherein the design of the building may be varied as desired, whilst still being constructed at least primarily using the same basic structural element.

According to the present invention, there is provided a structural element for a building or like structure comprising a panel member; said panel member including first and second, parallel, external faces and having at least one pair of parallel opposing sides, said panel member having an edge portion extending along each of said opposing sides, each of said edge portions being adapted in use to interconnect with an adjacent structural element; a first one of said edge portions comprising first and second flange members extending longitudinally along one side of said panel member, said first and second flange members being spaced to define between them a first recess which extends longitudinally along said one side of the panel member; and the second one of said edge portions comprising third and fourth flange members extending longitudinally along the opposing side of said panel member, said third and fourth flange members being spaced to define between them a second recess which extends longitudinally along said opposing side of the panel member; said first flange member being disposed outwardly of the plane of one of said external faces of the panel member to increase the structural strength of the element, said second flange member being adapted in use to be received within the second recess of a first identical structural element adjacent to said first edge portion of the panel member and said third flange member being adapted in use to be received within the first recess of a second identical structural element adjacent to said second edge portion of the panel member so that in use said first and second external faces of said panel member are coplanar with the first and second external faces respectively of the panel members of said adjacent identical structural elements.

Preferably, the first flange member has laterally spaced first and second inclined faces, the first inclined face extending downwardly from the first external face of the panel member, a first side face extending between the inclined faces so that the intersections between the first side face and the inclined faces define obtuse included angles, and the second side face extending parallel to the first side face and intersecting the second inclined face to define an acute included angle. Preferably also, the second flange member has laterally spaced first and second side faces and a transverse face extending between the side faces; the first side face of the second flange member extending parallel to the second side face of the first flange member, the second side face of the second flange member being inclined with respect to the first side face thereof and extending to the second external face of the panel member and defining an obtuse included angle at the intersection therewith. Preferably also, the fourth flange member has first and second side faces, the side faces intersecting to define an acute included angle therebetween and the second side face being coplanar with the second external face of the panel member.

The structural element of this invention is adapted for use in one aspect as a floor, internal and/or external wall, or ceiling element, and in this aspect of the invention, the elements provide the full structural requirements of the floor, wall, or ceiling by forming a supporting column providing structural strength at the interconnection of the edge portions of adjacent structural elements and providing a cladding function inbetween these supporting columns. In this aspect of the invention, the second side face of the first flange member is preferably coplanar with the first external face of the panel member, and the third flange member has laterally spaced first and second side faces and a tranvserse face extending between the side faces, the first side face being coplanar with the first external face of the panel member and the second side face extending parallel thereto.

In a further aspect, the structural element of this invention is adapted for use as a roof element and in this aspect of the invention the elements provide not only the structural requirements of the roof but also additional weatherproofing functions in view of the need to prevent penetration of rain water through a roof. In this further aspect of the invention, the second side face of the first flange member extends in a plane parallel to and outwardly of the plane of the first external face of the panel member; and the third flange member has laterally spaced first and second side faces, a transverse face extending between the side faces and an inclined face extending outwardly from the first external face of the panel member to the first side face and defining an obtuse included angle at the intersection therewith, the first side face extending in a plane parallel to and outwardly of the plane of the first external face of the panel member and the second side face extending parallel thereto.

Where the structural element of the present invention is designed for use as a planar member, such as a floor, wall or ceiling unit, the panel member preferably comprises a pair of generally parallel, spaced, planar side members, the side members extending between the first and second edge portions of the panel member and the facing surfaces of the side members, together with the edge portions, defining a hollow core extending longitudinally of the panel member.

In a further aspect of the invention, however, where the structural elements are intended for use as roof members, the panel member may comprise a pair of generally parallel, spaced, side members of generally inverted V-shape in longitudinal section, the side members extending between the first and second edge portions of the panel member and the facing surfaces of the side members, together with the edge portions, defining a hollow core extending longitudinally of the panel member. Panel members of this generally inverted V-shape may be used as an entire span from side to side of a building structure and, since the structural elements provide all the structural requirements necessary thereto, a roof structure may be constructed of a plurality of these elements spanning from side to side of a building without additional supporting structures.

The structural elements of the present invention are preferably constructed of concrete or other structural and/or fire-resisting material. The material may be reinforced or prestressed (pre- or post- tensioned) and in one preferred embodiment of the present invention the reinforcement comprises expanded metal sheeting which is incorporated into the structural element in a manner described in more detail below, as well as the normal reinforcing bars in the flange members of the elements.

As noted above, it is an important feature that the structural elements of this invention are designed to carry out the functions of solar energy collection, storage and the like. Where it is desired to construct an element which is capable of carrying out these functions, one of the generally parallel, spaced side members of the panel member as described above is constructed so as to be transparent, and means to collect solar energy transmitted through the transparent side member are incorporated into the hollow core of the panel member. The transparent side member may be constructed of one or more transparent members of a material such as glass or transparent plastic. The means to collect solar energy transmitted through this transparent side member may comprise either means to transfer the solar energy to a fluid collection and/or storage medium, or means to convert the solar energy into electrical or other energy. In a preferred aspect of this invention, the means to collect solar energy comprises a solar collector plate incorporating one or more heat transfer pipes to convey or store fluids such as water, air or the like. Additionally, or alternatively, the means to collect solar energy transmitted through the transparent side member may include a photovoltaic energy conversion or similar solar energy conversion system. The panels may also incorporate reflecting and/or concentrating members for solar energy. The panel member may also contain within its hollow core suitable insulating material in order to assist in the retention of solar energy transmitted into the core, together with heat barriers, thermal shields and the like in order to maximise the utilisation of this transmitted solar energy. The energy which is collected and/or stored by a structural element as described above may be used for the purposes of space heating inside a building incorporating the structural element, or for the provision of a hot water supply, refrigerating unit or other heat or electrical appliance, in such a building. In order to carry out these functions, appropriate distribution and delivery systems for fluid heated in the fluid collection and/or storage means may be interconnected with the structural element. Similarly, where the solar heat energy has been converted into electrical energy, appropriate distribution and delivery systems may be incorporated into a building utilising the structural element of this aspect of the invention.

In particularly preferred embodiments of this invention, the structural element may be constructed so that the panel member is a wall panel member and includes at least one window and/or door and the associated framework therefor. Windows and doors of all types may be incorporated into the wall panel member in the manner illustrated in more detail hereinafter.

As described above, the structural elements of this invention are intended for use in construction of building structures, and in a further aspect, this invention provides a building structure including a wall, floor or ceiling structure made up of a plurality of structural elements in which the panel member comprises a pair of generally parallel spaced, planar side members as described above, each of the structural elements being interconnected with the adjacent structural element by interconnection of the respective adjacent end portions thereof. Such a building structure may include a pair of wall structures as described above, these structures extending in intersecting orthogonal directions to form a corner, and the corner member which engages with each of the structural elements defining this corner. Further details of suitable corner members are described hereinafter.

In yet another embodiment of this invention, there is provided a building structure including a roof structure made up of a plurality of structural elements in which the panel member comprises a pair of generally parallel, spaced side members of generally inverted V-shape of varying module width in either side of the apex in longitudinal section as described above, each of the structural elements being interconnected with the adjacent structural element by interconnection of the respective adjacent edge portions thereof. Such a building structure may include a pair of roof structures as described above, the roof structures extending in intersecting orthogonal directions to form an intersecting zone therebetween, and a generally inverted V-shaped beam of varying length on either side of the apex extending across the intersecting zone, the beam receiving and supporting the respective ends of the roof structures forming the intersecting zone. Once again, the detailed construction of such a beam is described in more detail hereinafter.

The structural element of the present invention and building structures including a plurality of such structural elements, is considered to provide an answer, or at least an acceptable alternative, to industrialised housing as known to date, and to meet consumer prejudices thereto. Furthermore, the alternative energy utilisation which is enabled in accordance with the present invention provides an advantage which is not readily obtainable in any alternative system. The structural elements which are to be used for floor, wall (internal and/or external), sealing and roof members in accordance with the present invention are structuralised and functionalised from the building and solar point of view, and can be moulded from a single relatively inexpensive mould system to satisfy any side, floor or roof requirement. The manufacturing and assembly tolerances are used to act as concealed expansion joints in the lateral direction and to provide vertical articulation between elements to accommodate geometrical variation and also facilitate accommodation of varying site slopes. Since the material used in the construction of the structural elements of this invention may be normal weight concrete, reinforced by means of expanded metal and normal reinforcing bars, erection of the structural elements of this invention into a building structure can be achieved quickly and by use of relatively inexpensive labour.

Further features of the present invention will be apparent from the following description of preferred embodiments of the various aspects of the invention which are included in the present specification by way of exemplification of the invention and not by way of limitation thereof.

Figure 11:
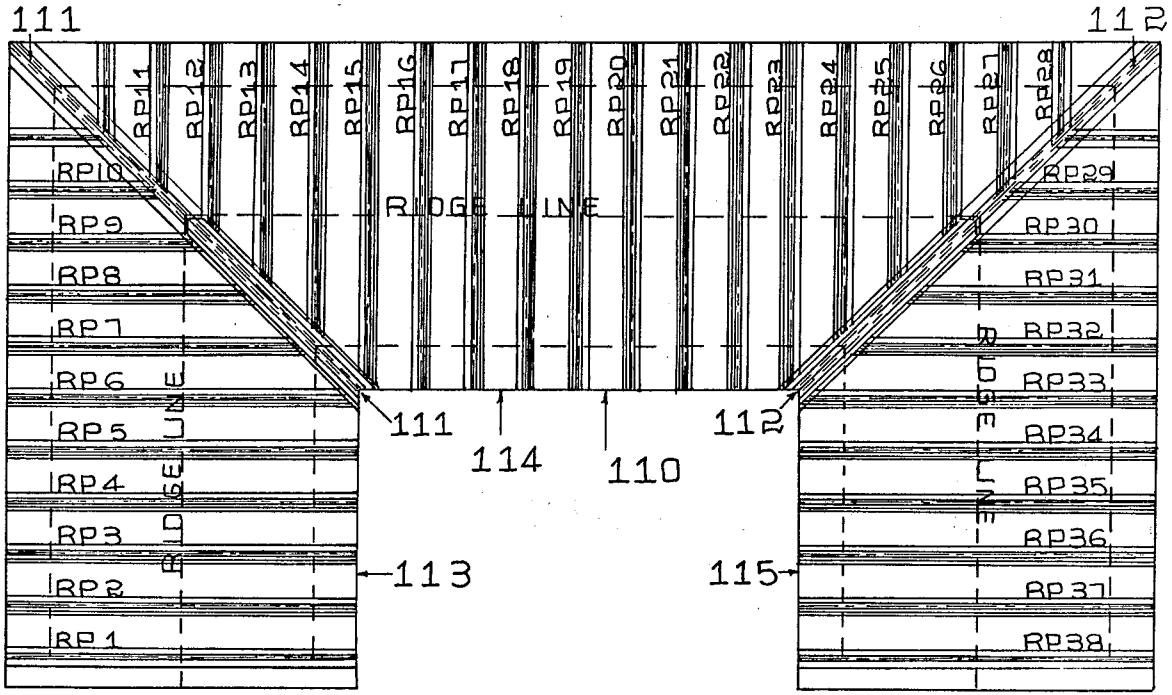
FIG. 11 is a plan view of a roof structure utilising roof panels in accordance with the invention.

FIGS. 13A, 13B, 13C and 13D are a plan view, a front elevational view, a longitudinal sectional view and a rear elevational view respectively of a standard roof panel of the roof structure of FIG. 11; and FIGS. 14A, 14B, 14C and 14D are a plan view, a front elevational view, a longitudinal sectional view and a rear elevational view respectively of a typical modified roof panel of the roof structure of FIG. 11.

Figure 1:
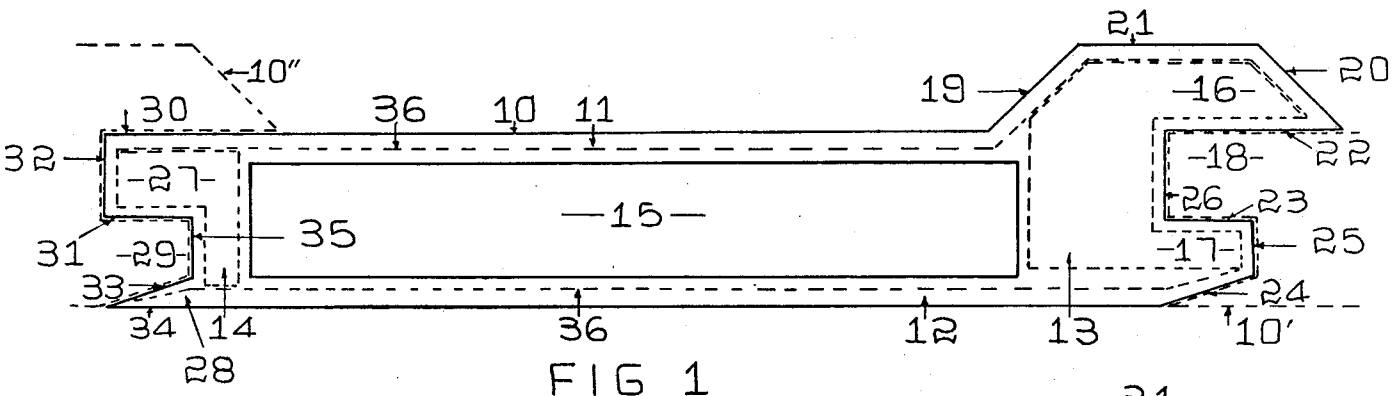
FIG. 1 is a cross-sectional view of a standard wall panel in accordance with the invention.

Referring firstly to FIG. 1, standard wall panel 10 comprises a pair of opposed spaced, parallel first and second side members 11 and 12, and opposed, first and second end portions 13 and 14 respectively. Side members 11 and 12 and end portions 13 and 14 define between them a hollow core 15 extending longitudinally of the panel 10.

As illustrated, first edge portion 13 comprises first and second flanges members 16 and 17 extending longitudinally of the panel 10, flange members 16 and 17 defining between them first recess 18 which also extends longitudinally of the panel 10.

First flange member 16 has laterally spaced first and second inclined faces 19 and 20, inclined face 19 extending outwardly from the external face of side member 11. A first side face 21 extends between inclined faces 19 and 20 and defines obtuse included angles with those faces. A second side face 22 extends parallel to first side face 21 and intersects inclined face 20 to define an acute included angle. Side face 22 is generally coplanar with the external face of side member 11. Second flange member 17 has laterally spaced first and second side faces. 23 and 24 and a transverse face 25 extending between these side faces. Side face 24 is inclined with respect to side face 23 and extends to and intersects the external face of side member 12 at an obtuse included angle. First recess 18 is defined by parallel side faces 22 and 23 of the first and second flange members 16 and 17 respectively, and by transverse base 26.

Second edge portion 14 comprises third and fourth flange members 27 and 28 extending longitudinally of the panel 10, flange members 27 and 28 defining between them second recess 29 which also extends longitudinally of the panel 10.

Third flange member 27 has laterally spaced first and second side faces 30 and 31 and a transverse face 32 extending between the side faces. Side face 30 is coplanar with the external face of side member 11 and side face 31 is parallel thereto. Fourth flange member 28 has first and second side faces 33 and 34 which intersect to define an acute included angle. Side face 34 is coplanar with the external face of side member 12. Second recess 29 is defined by side faces 31 and 33 of the third and fourth flange members 27 and 28 respectively and by transverse base 35.

As will be apparent from FIG. 1, first flange member 16 is disposed outwardly of the plane of the external face of the side member 11, second flange member 17 is in use received within the second recess of a first identical adjacent panel 10′ and third flange member 27 is in use received within the first recess of a second identical adjacent panel 10″.

Reinforcing material, for example expanded metal sheets, may be incorporated within the panel 10 as indicated by the dotted outline 36 in FIG. 1, and normal reinforcing bars in flange members 13, 14, 16, 17, 27 and 28.

Figure 2:
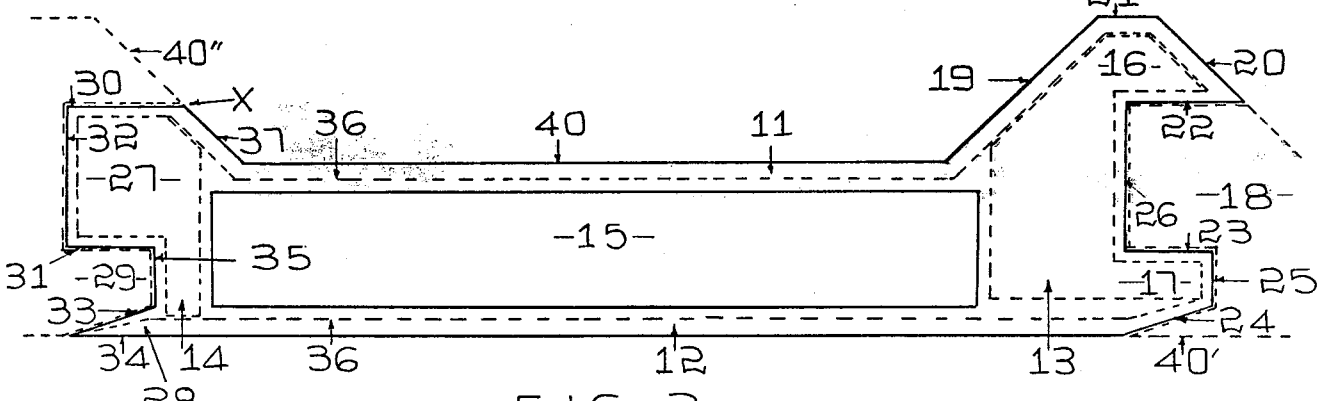
FIG. 2 is a cross-sectional view of a standard roof panel in accordance with the invention.

The standard roof panels 40 illustrated in FIG. 2 is in most respects identical to the panel 10 of FIG. 1 and like components thereof have been identified by like numerals. It will, however, be noted that in order to locate the upper connecting level of the roof panels (indicated by arrow X) above the water line of the panel 40 (which is the external face of side member 11), second side face 22 of first flange member 16 extends in a plane parallel to but outwardly of the external face of side member 11, and third flange member 27 includes an inclined face 37 extending outwardly from the external face of side member 11 to the side face 30 and defines an obtuse included angle therewith. Side face 30 extends in a plane parallel to but outwardly of the external face of side member 11.

In a typical case, the modular length of the wall panel 10 of FIG. 1 and the roof panel 40 of FIG. 2 is 900 mm, and the distance between surfaces 26 and 32 is 897 mm, with the side members 11 and 12 of 25 mm thickness between the internal and external faces thereof. Core 15 is of width 99 mm between the opposing internal faces of members 11 and 12. As described above, flange members 16 and 17 provide flexural structural strength to roof panel 40 and flange members 16, 17, 27 and 28 provide the column functions in wall panel 10, and in the case of wall panel 10, the length of member 16 between the intersection of inclined face 19 with the external face of side member 10 and the intersection of inclined face 20 and side face 22 is 300 mm, and the thickness of member 16 between the side faces 21 and 22 is 74 mm. The overall thickness of panel 10 at the first edge portion 13 thereof, between side face 21 and the external face of side member 12 is 225 mm. In the case of roof panel 40, the length of member 16 as noted above is 250 mm, and the thickness of this member is 74 mm. The overall thickness of panel 40 at the first edge portion 13 thereof is 275 mm. In addition, the distance between the intersections of inclined face 37 of panel 40 with the side face 30 and the external face of side member 11 is 50 mm.

Figure 3:
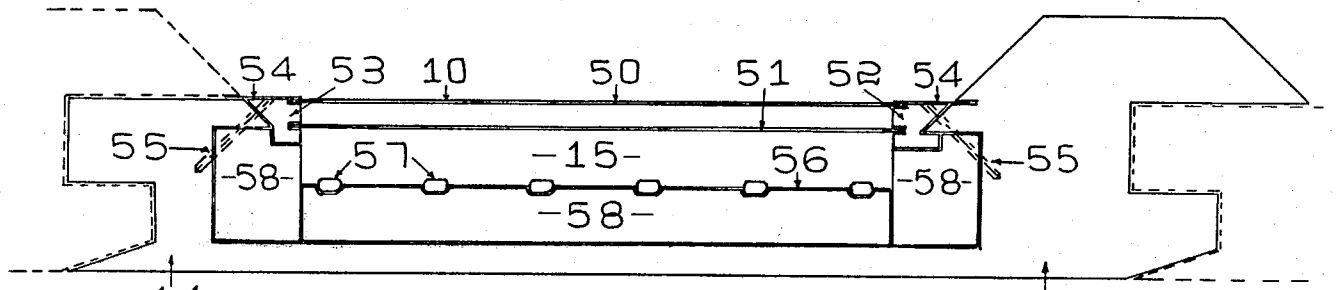
FIG. 3 is a cross-sectional view of a solar collector modification of the standard wall panel of FIG. 1.
Figure 4:
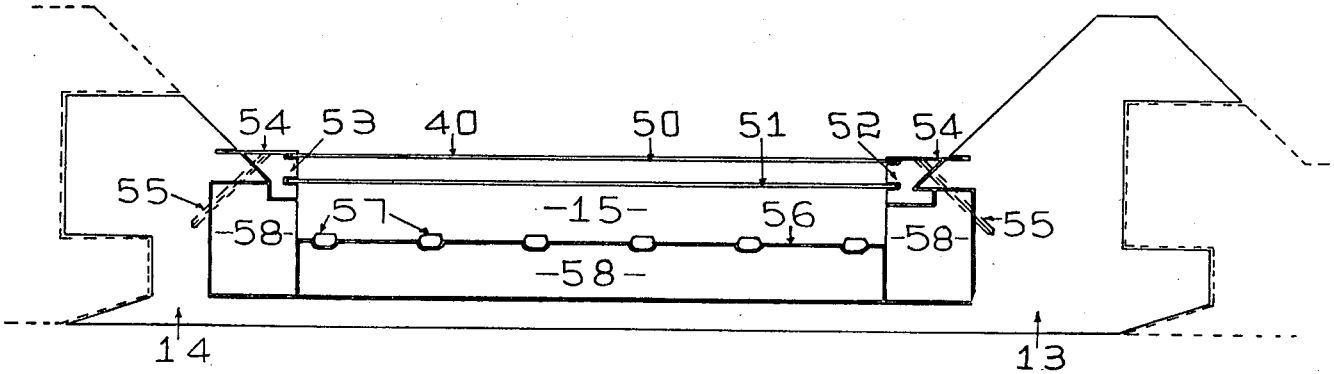
FIG. 4 is a cross-sectional view of a solar collector modification of the standard roof panel of FIG. 2.

Turning now to FIGS. 3 and 4 of the drawings, it will be seen that the solar collector modifications illustrated are again in many respects identical with the wall and roof panels 10 and 40 of FIGS. 1 and 2 respectively. In these modified embodiments, however, side member 11 is replaced by a pair of parallel transparent glass plates 50 and 51 which are suitably mounted by mounting means 52 and 53 at the edges of the plates adjacent to the first and second end portions 13 and 14 respectively. Mounting means 52 and 53 may comprise a suitably configured resilient member which is held in position by an external casing 54 which itself is secured to the panel member by means 55 such as screws, pins or the like. Within the core 15 of each of the embodiments of FIGS. 3 and 4 there is located a solar collector system comprising a plate 56 having tubes 57 integral therewith for the storage or passage of a fluid such as water or air. Insulating material 58 is also provided within core 15 to assist in the collection and/or storage of solar energy passing through glass plates 50 and 51. It will, of course, be appreciated that if desired, glass plate 51 may be dispensed with, or additional glass plates included, in the embodiments of FIGS. 3 and 4. In addition, although not illustrated, heat traps reflectors, heat barriers and the like may also be incorporated into the panels to assist in the concentration and subsequent collection and/or storage of solar and other energy.

Figure 5:
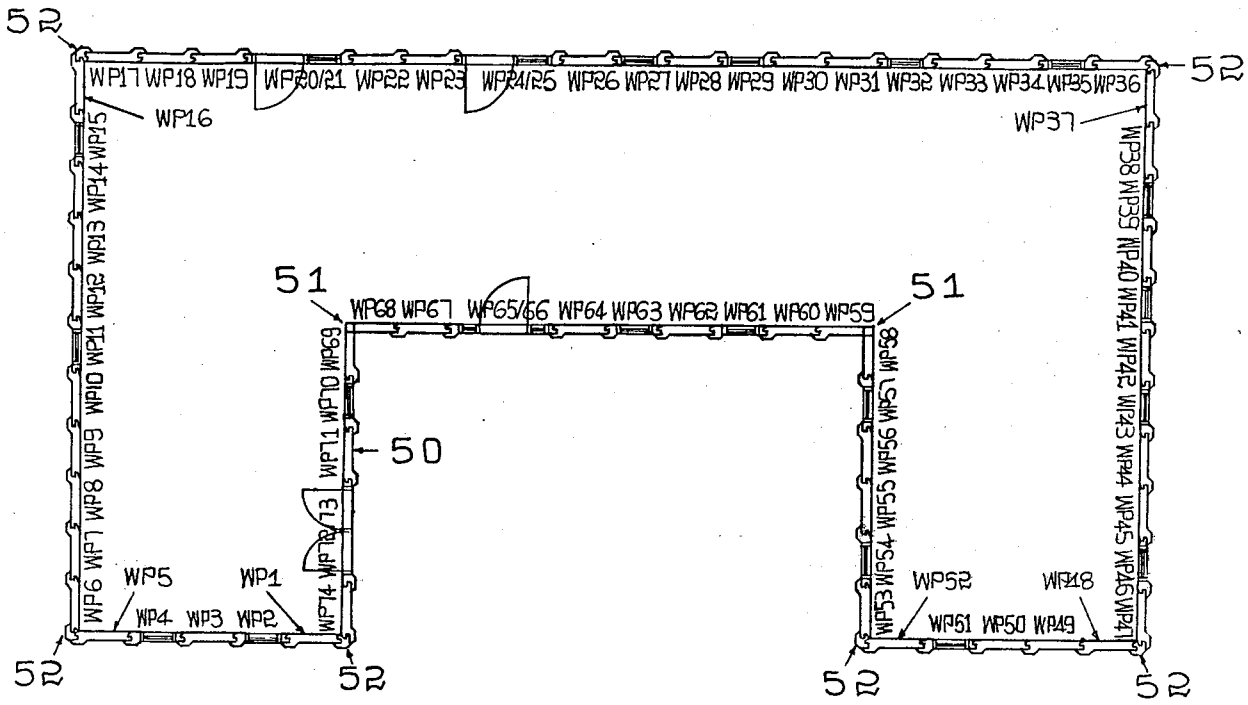
FIG. 5 is a plan view of a wall structure utilising wall panels in accordance with the invention.

FIG. 5 shows an external wall structure for a typical single-storey residence which utilises wall panels of the type illustrated in FIG. 1. As shown, the structure 50 comprises modular wall panels WP-1 through WP-74 which may, for example, be manufactured on the basis of a 900 mm wide module. Whilst the majority of the panels, such as panels WP-1, WP-3 and WP-5 are standard wall panels, certain of these panels incorporate at least one window and/or door and the associated frame work therefor which is incorporated into the side members of the panel. Thus, panels such as WP-2 and WP-4 incorporate full- or half-length windoes, while panels WP-20/21 and WP24/25 (which are each equivalent to two modules in width) incorporate both a door and a window. Finally, panel WP-72/73 incorporates double doors. When a two- or more-module-width window or door unit is to be incorporated into the structure a suitable frame is provided consisting of a pair of columns incorporating edge portions 13 and 14 of FIG. 1 and a solid lintel between those columns at the upper level of the window or door. It will, of course, be appreciated that by suitable arrangement of standard wall panels and window and/or door containing wall panels, any suitable external wall configuration may be constructed. In addition, it will be understood that some of the standard wall panels used in structure 50 may be replaced by solar collector modifications thereof as shown in FIG. 3, in single or multiple-module-width or in full or part length of the panel.

Figure 6B:
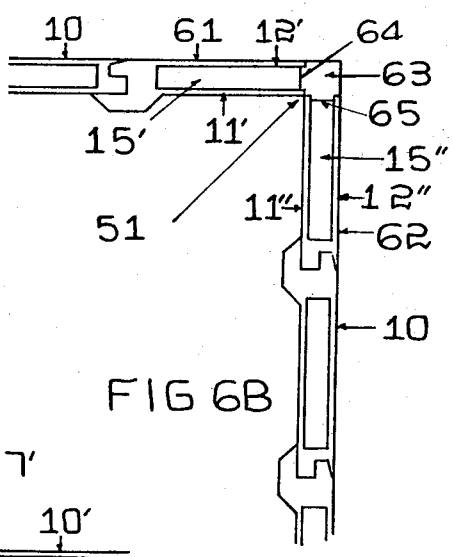
FIGS. 6A & 6B are plan views of internal corner structures in the wall structure of FIG. 5.
Figure 6A:
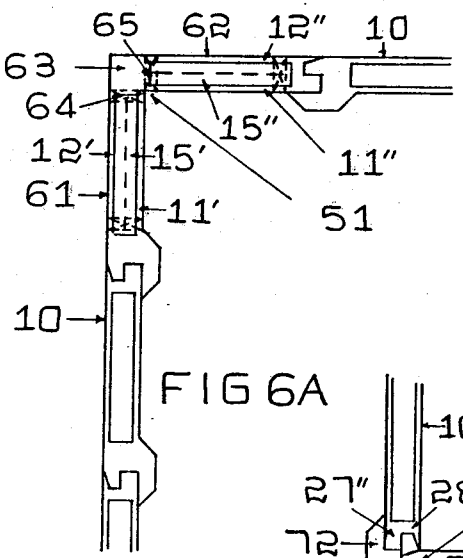
Figure 7:
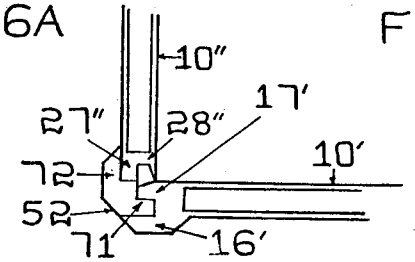
FIG. 7 is a plan view of an external corner structure in the wall structure of FIG. 5.

In order to maintain inter-engagement between those portions of the wall structure 50 which define a corner of the structure, internal corner structures 51 and external corner members 52 are provided in the structure. These are shown in more detail in FIGS. 6 and 7 respectively. As shown in FIGS. 6A and 6B, internal corner structures 51 comprise a first member 61 having a first end portion 13 as in a standard panel and a pair of parallel spaced side members 11' and 12' defining core 15, a second member 62 having a second end portion 14 as in a standard panel and a pair of parallel, spaced side members 11" and 12" defining core 15", and a corner member 63 of generally square cross section having first and second flanges 64 and 65 extending longitudinally thereof on adjacent side faces, the flanges 64 and 65 engaging in the cores 15' and 15" respectively to form the corner structure 51 as shown. FIG. 6A illustrates by means of dotted outline that just as standard panels 10 may incorporate, for example, a window and the associated framework therefor, members 61 and 62 may also incorporate a window if desired. As shown in FIG. 7, external corner member 52 is constructed to engage the first end portion 13 of one panel 10' defining the corner by means of a flange member 71 similar to the third flange member 27 of a standard panel 10, and to engage the second end portion 14 of the other panel 10" defining the corner by means of a flange member 72 similar to the first flange member 16 of a standard panel 10. The flange member 72 thus combines with first flange member 16' of panel 10' to form an aesthetically pleasing corner structure. The wall units and the corner units may be connected by a separate U-shaped bar either at the top, or bottom, or both.

Figure 9:
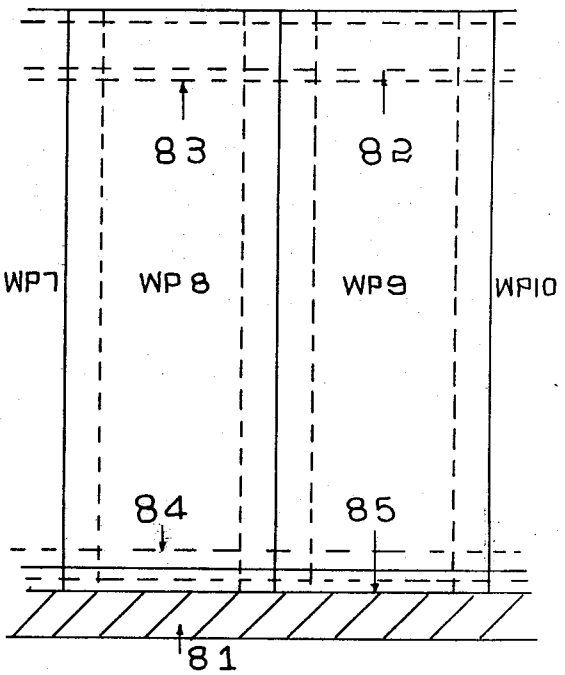
FIG. 9 is an internal elevational view of the wall structure illustrated in FIG. 8.
Figure 8:
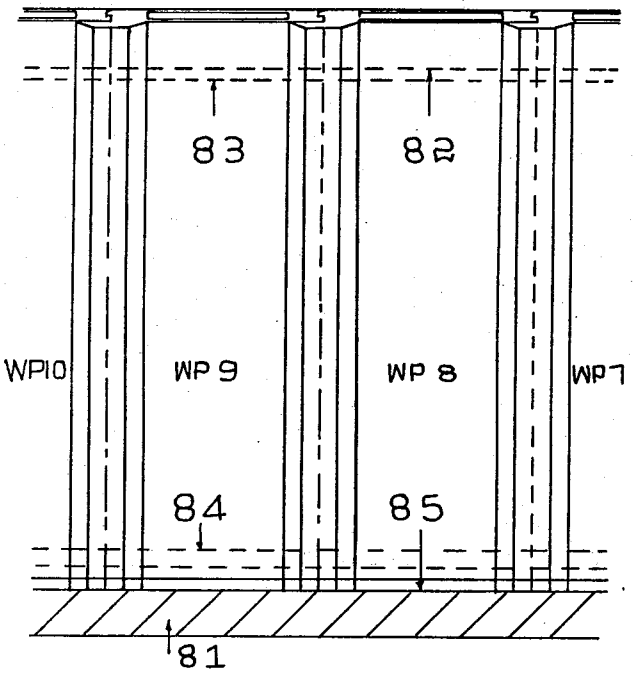
FIG. 8 is an external elevational view of a wall structure comprising a plurality of wall panels as illustrated in FIG. 1.

FIGS. 8 and 9 are external and internal views respectively of portion of the structure 50 shown in FIG. 5 and comprised of wall panels WP-7, WP-8, WP-9 and WP-10. The wall panels are constructed so that the lower ends 35 rest upon a beam, base member or the like 81 and extend vertically upwardly therefrom. The upper ends of these wall panels are sloped from the inner faces thereof to the outer faces so that the generally inverted V-shaped roof panels may be stably supported on the bevelled upper ends in a manner to be described in more detail below, with the roof panels extending outwardly thereof to a lower eaves level 82. As previously described, the wall panels may include at least one window and/or door and the associated framework therefor, and typically such windows or doors would be incorporated in the panel between the upper level 83 and the lower level 84. As is particularly shown in FIG. 9, the bevelled upper ends of wall panels such as WP-7 to WP-10 ensures that the inner faces of the panels can contact the lower sides of roof panels along a single level, thereby avoiding the necessity for cover strips or the like, while at the same time facilitating the expansion of the roof panels in the direction perpendicular to the concealed expansion joints.

Figure 10:
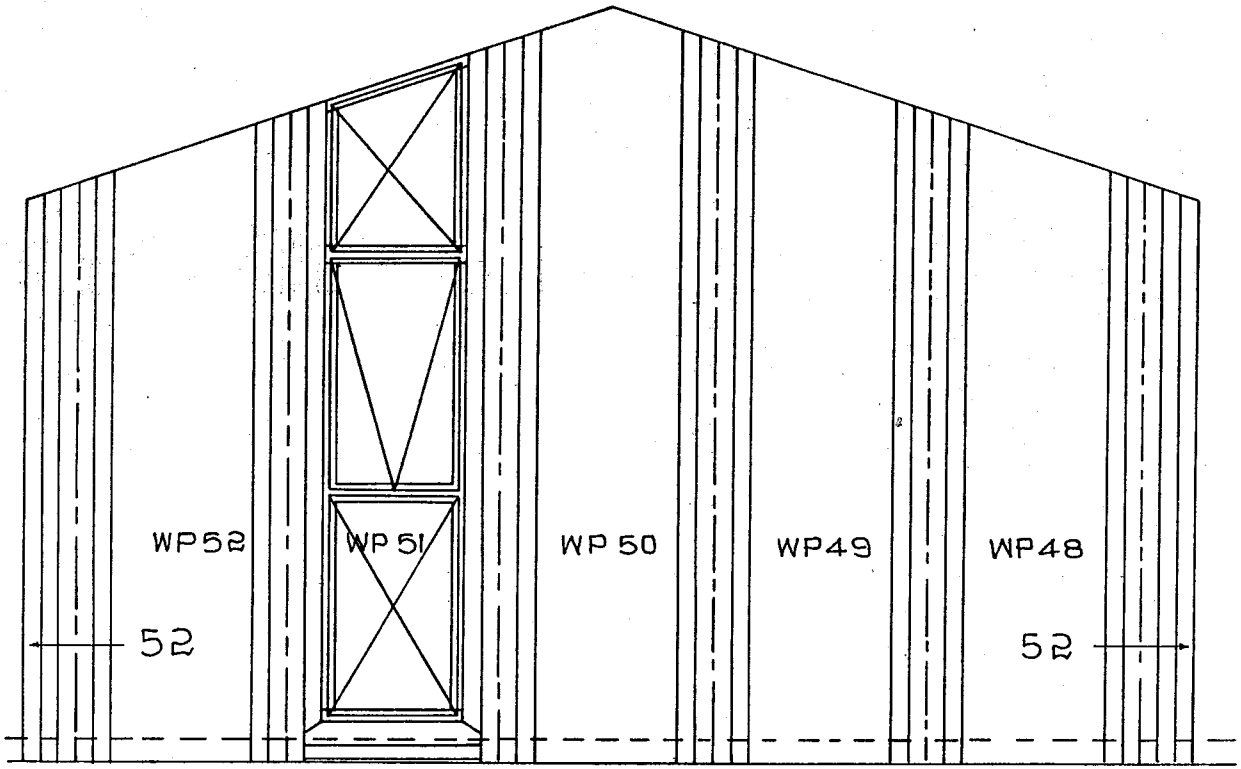
FIG. 10 is an external elevational view of an alternative wall structure comprising a plurality of wall panels as illustrated in FIG. 1.

FIG. 10 illustrates a further portion of the structure 50 shown in FIG. 5 and comprised of wall panels WP-48, WP-49, WP-50, WP-51 and WP-52, as well as a pair of external corner members 52. This portion forms the "hip"-end of the wall structure and it will be seen that the upper ends of the wall panels slope from one end portion thereof to the other so that the top of the structure is a generally inverted V-shape to match and engage the underside of a roof panel of the same shape.

Turning now to FIG. 11, there is shown a typical roof structure 110 of the "hip" type which is made up utilising roof panels in accordance with the present invention and designed as the roof structure for the wall structure 50 of FIG. 5. Structure 110 comprises modular roof panels RP-1 through RP-38, which again may be manufactured on the basis of a 900 mm module to correspond with the wall panels, and a pair of identical hip-valley beams 111 and 112 which support the roof panels at the intersecting zones between the three roof portions 113, 114 and 115. The majority of the panels making up the structure 110 are standard roof panels having the cross-section shown in FIG. 2, however panels RP-1 and RP-38 are modified so as to incorporate an overhanging eaves portion at the end of roof portions 113 and 115 respectively, and panels RP-10, RP-11, RP-28 and RP-29 are also modified so at to form the external corners between the roof portions 113 and 114, and 114 and 115, respectively. In addition, panel RP-19 comprises a special panel in so far as each of the edge portions thereof has the third and fourth flange members 27 and 28 and recess 29 of a standard roof panel 40.

FIGS. 13A to 13D illustrate in plan, elevation and section features of the full-length roof panels RP-2 to RP-4, RP-17, RP-18, RP-20 to RP-22 and RP-35 to RP-37 of the roof structure 110, and the manner in which such panels rest upon standard wall panels 10 at either end thereof. Roof panels RP-6 to RP-8, RP-13 to RP-16, RP-23 to RP-26 and RP-31 to RP-34 are modified so that the "inner" ends thereof which define the respective intersecting zones between roof portions 113, 114 and 115 are adapted to be supported by the hip-valley beams 111 and 112. Panels RP-9, RP-12, RP-27 and RP-30 are further modified to accommodate the hip-valley transition characteristics of these roof panels. Panels RP-8 and RP-26 are shown by way of example in FIGS. 14A to 14D in plan, elevation and section, and it will be apparent that the inner end of panel 40' is angled from one edge portion 13' thereof to the other edge portion 14' to meet and rest upon a supporting surface of the hip-valley beam 111 which extends at an angle to the panel 40.

Figure 12A:
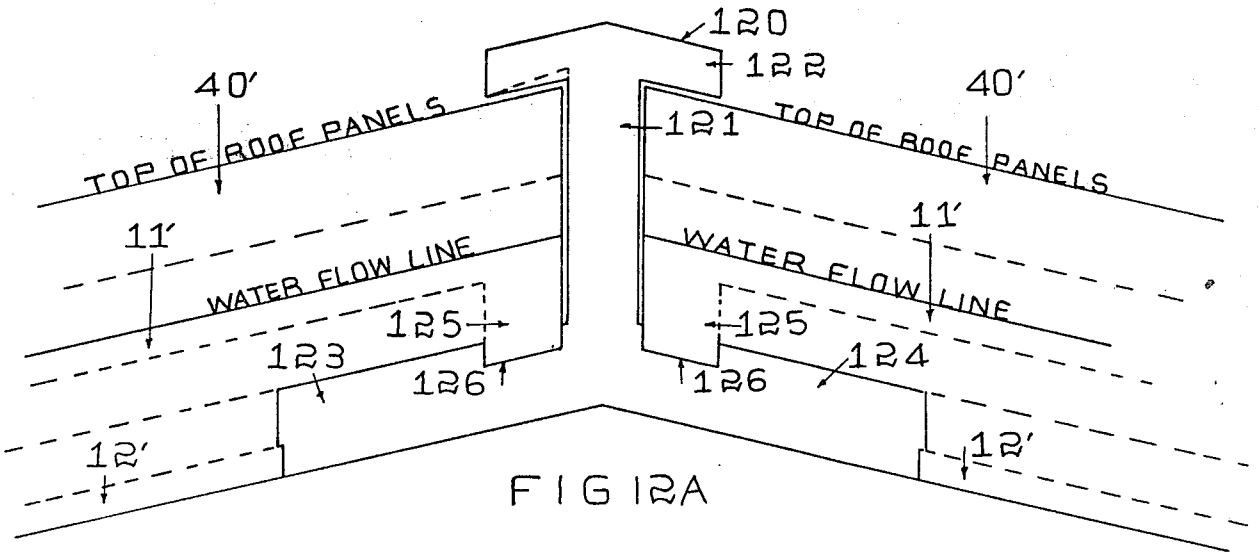
FIG. 12A and 12B are cross-sectional views of the hip-part and the valley-part respectively of the hip-valley beam of the roof structure of FIG. 11.
Figure 12B:
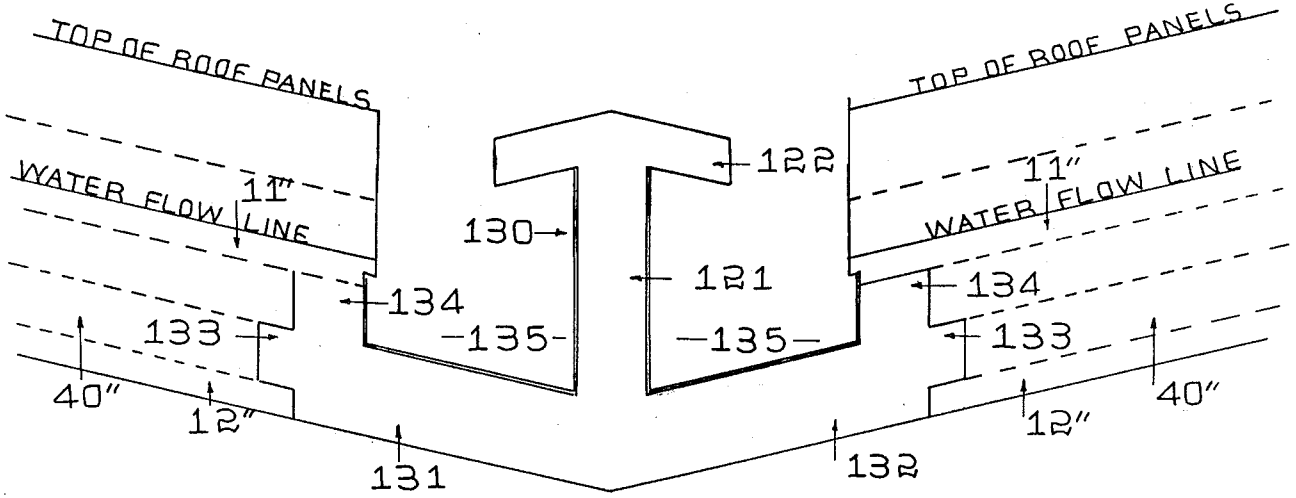
Figures 13A, 13B, 13C, 13D, 14A, 14B, 14C, 14D:
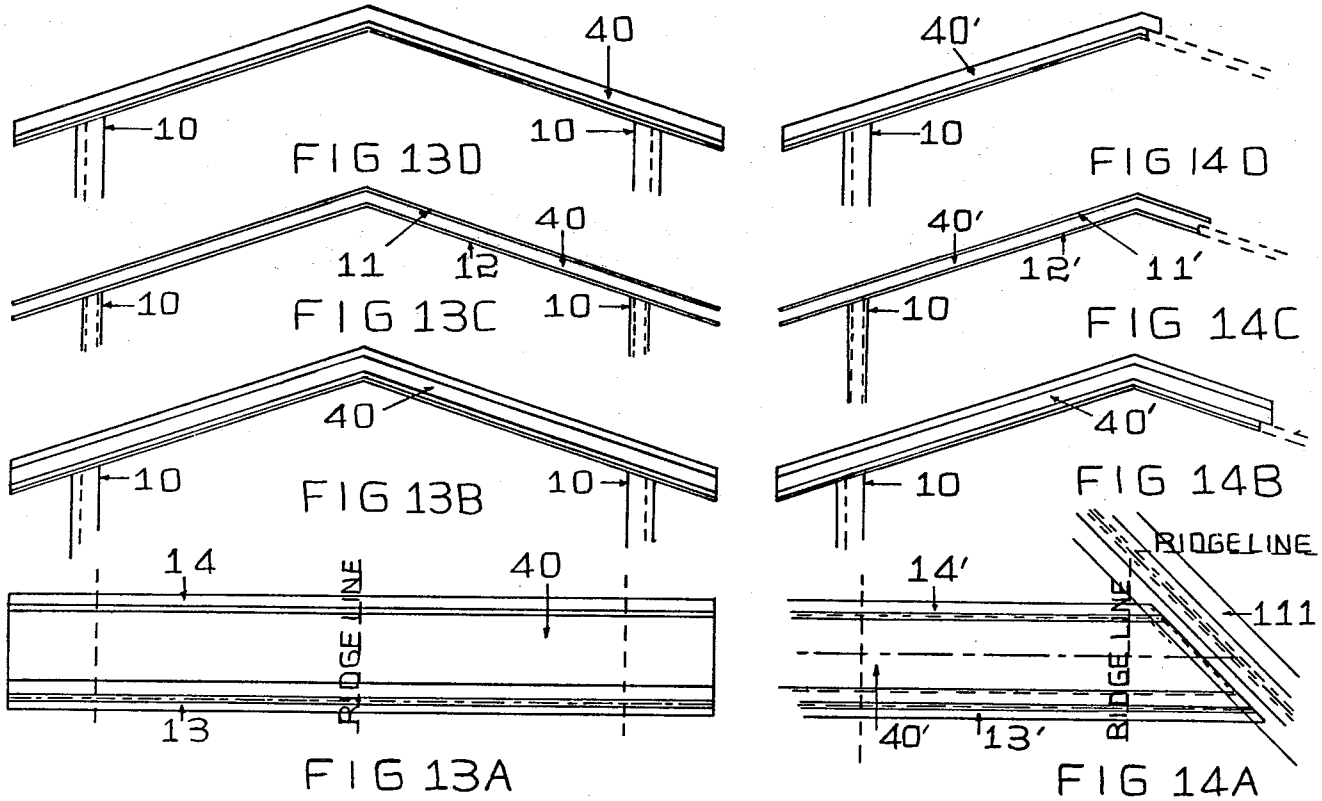

FIGS. 12A and 12B show features of the hip-valley beams 111 and 112 of roof structure 110, as well as the connection between these beams and the various roof panels forming the intersecting zones of the roof structure 110. FIG. 12A shows the "hip" part 120 of beam 111 as being generally inverted T-shape in cross-section and comprising a generally longitudinal member 121, a cap member 122 at the upper side thereof and a pair of laterally extending supporting members 123 and 124 extending to either side at the lower side of member 121. Supporting members 123 and 124 slope downwardly from the member 121 to match the slope of the roof panels 40' supported thereby. As shown, the roof panels 40' are received below the cap member 122 on either side of the beam 111 and the panels are retained in position by means of a downwardly directed lug 125 on the panel 40' which engages a recess 126 on the upper surface of the supporting member 123 or 124. FIG. 12B shows the "valley" part 130 of beam 111 which is integral with the "hip" part shown in FIG. 12A in the generally inverted V-shaped beam. Again, part 130 is generally inverted T-shape in cross-section and comprises longitudinal member 121 and cap member 122 at the upper side thereof. At the lower side of member 121 supporting members 131 and 132 slope upwardly from member 121 to match the slope of the roof panels 40'' supported thereby. Panels 40'' are retained in position by means of lugs 133 and 134 at the outer end of each of the supporting members 131 and 132 so that a drainage gutter 135 is formed on either side of longitudinal member 121. If desired, this drainage gutter may be lined with galvanised iron or similar material.

It will be understood that while particular embodiments of the invention have been described and illustrated herein in detail for the purposes of exemplification of the present invention, many variations and modifications may be made thereto without departing from the spirit and scope of the invention as broadly described herein, including columns, frames, walls and roofs, and it is intended that all such modifications and variations be included within the scope of the claims.

I claim:

1. A modular, concrete structural element for a building or the like structure comprising a panel member; said panel member including a pair of parallel, spaced apart side members having first and second, parallel, external faces, said panel member having a pair of edge portions extending between and along the edges of said side members to define a hollow core extending longitudinally of said panel member, each of said edge portions having flange means for providing structural strength to said structural element and said flange means being so dimensioned relative to each other so as to form a cavity with the flange means of an adjacent edge portion of an adjacent structural element to provide a concealed, weatherproof expansion joint between the adjacent structural elements, said flange means on a first one of said edge portions comprising first and second flange members extending longitudinally along one side of said panel member, said first and second flange members being spaced to define between them a first recess which extends longitudinally along said one side of the panel member; and said flange means on a second one of said edge portions comprising third and fourth flange members extending longitudinally along the opposite side of said panel member, said third and fourth flange members being spaced to define between them a second recess which extends longitudinally along said opposing side of the panel member; said first flange member protruding outwardly of the plane of one of said external faces of the panel member to increase the structural strength of the element, said second flange member being adapted in use to be received within the second recess of an identical structural element adjacent to said first edge portion of the panel member and said third flange member being adapted in use to be received within the first recess of a second identical structural element adjacent to said second edge portion of the panel member so that in use said first and second external faces of said panel member are coplanar with the first and second external faces respectively of the panel members of said adjacent identical structural elements.

2. A structural element as defined in claim 1 wherein said first flange member has laterally spaced first and second inclined faces, said first inclined face extending outwardly from the first external face of the panel member, a first side face extending between said inclined faces so that the intersections between said first side face and said inclined faces define obtuse included angles, and a second side face extending parallel to said first side face and intersecting said second inclined face to define an acute included angle; said second flange member has laterally spaced first and second side faces and a transverse face extending between said side faces, said first side face of the second flange member extending parallel to said second side face of said first flange member, said second side face of said second flange member being inclined with respect to said first side face thereof and extending to said second external face of the panel member and defining an obtuse included angle at the intersection therewith; and said fourth flange member has first and second side faces, said side faces intersecting to define an acute included angle therebetween and said second side face being coplanar with said second external face of the panel member.

3. A structural element as defined in claim 2 wherein said second side face of said first flange member is coplanar with said first external face of the panel member; and said third flange member has laterally spaced first and second side faces and a transverse face extending between said side faces, said first side face being coplanar with said first external face of the panel member and said second side face extending parallel thereto.

4. A structural element as defined in claim 2 wherein said second side face of said first flange member extends in a plane parallel to and outwardly of the plane of said first external face of the panel member; and said third flange member has laterally spaced first and second side faces, a transverse face extending between said side faces and an inclined face extending outwardly from the first external face of the panel member to said first side face and defining an obtuse included angle at the intersection therewith, said first side face extending in a plane parallel to and outwardly of the plane of said first external face of the panel member and said second side face extending parallel thereto.

5. A structural element as defined in any one of claims 1 or 2 to 4, wherein said panel member has an inverted V-shaped in longitudinal section.

6. A structural element as claimed in claim 5, wherein one of said side members is transparent, and said hollow core incorporates means to collect solar heat energy transmitted through said transparent side member.

7. A structural element as defined in claim 1, wherein one of said side members is transparent, and said hollow core incorporates means to collect solar heat energy transmitted through said transparent side member.

8. A structural element as defined in claim 7 wherein said means to collect solar heat energy includes means to transfer said solar heat energy to a fluid collection and/or storage medium.

9. A structural element as defined in claim 7, wherein said means to collect solar heat energy includes means to convert said solar heat energy into electrical energy.

10. A structural element as defined in any one of claims 1 or 2 to 4 wherein said panel member is a wall panel member and includes at least one window and/or door and the associated framework therefor.

11. A building structure including a wall, floor or ceiling structure made up of a plurality of structural elements as defined in claim 1, each of said structural elements being interconnected with the adjacent structural element by interconnection of the flange means on respective adjacent edge portions thereof.

12. A building structure including a pair of wall structures as defined in claim 11, said structures extending in intersecting orthogonal directions to form a corner, and a corner member which engages with each of the structural elements defining the said corner.

13. A building structure including a roof structure made up of a plurality of structural elements as defined in claim 5, each of said structural elements being interconnected with the adjacent structural element by interconnection of the respective adjacent edge portions thereof.

14. A building structure including a pair of roof structures as defined in claim 13, said roof structures extending in intersecting orthogonal directions to form an intersecting zone therebetween, and a generally inverted V-shaped beam extending across said intersecting zone, said beam receiving and supporting the respective ends of said roof structures forming said intersecting zone.

* * * * *